US009822532B2

(12) United States Patent
Sherry

(10) Patent No.: US 9,822,532 B2
(45) Date of Patent: Nov. 21, 2017

(54) GABLE VENT THAT BLOCKS FIRE, RAIN AND WATER

(71) Applicant: George John Sherry, Yorba Linda, CA (US)

(72) Inventor: George John Sherry, Yorba Linda, CA (US)

( * ) Notice: Subject to any disclaimer, the term of this patent is extended or adjusted under 35 U.S.C. 154(b) by 109 days.

(21) Appl. No.: 14/942,041

(22) Filed: Nov. 16, 2015

(65) Prior Publication Data

US 2016/0146499 A1 May 26, 2016

Related U.S. Application Data

(60) Provisional application No. 62/084,016, filed on Nov. 25, 2014, provisional application No. 62/160,818, filed on May 13, 2015.

(51) Int. Cl.
*E04D 13/17* (2006.01)
*F24F 13/08* (2006.01)

(52) U.S. Cl.
CPC ..... *E04D 13/17* (2013.01); *F24F 13/085* (2013.01); *F24F 2221/30* (2013.01); *F24F 2221/52* (2013.01)

(58) Field of Classification Search
CPC ..... F24F 13/08; F24F 13/085; E04D 13/17
See application file for complete search history.

(56) References Cited

U.S. PATENT DOCUMENTS 1,972,991 A * 9/1934 Hinkle ..... F24F 13/08 454/277
2,239,767 A 4/1941 Anderson
2,480,562 A * 8/1949 Ewing ..... B63J 2/10 160/104
2,638,836 A 5/1953 Hull
2,956,496 A * 10/1960 Simblest ..... F24F 13/08 454/283
3,358,580 A * 12/1967 Freese ..... B01D 45/08 454/277
4,214,510 A 7/1980 Ward
4,310,993 A * 1/1982 White ..... E06B 7/082 454/277
4,406,095 A 9/1983 Slavik
4,785,596 A * 11/1988 Wiley ..... F24F 13/08 454/250

(Continued)

*Primary Examiner* — Steven B McAllister
*Assistant Examiner* — Jonathan Cotov
(74) *Attorney, Agent, or Firm* — Kirk A. Buhler; Buhler & Associates

(57) ABSTRACT

Improvements in an outside house vent that blocks embers, water and rain that can cause damage to a house of building. The prevention of fire and ember intrusion into a building prevents fires in homes where invalids and children are left alone. The prevention of water into structure further reduces the potential for mold growth in the attic or walls of a home or structure. The filtering further prevents intrusion of creatures such as but not limited to bugs, insects, bees, wasps, animals, critters and other flying and crawling animals from entering the building. The vent is a fireproof set of louver or filter pads with fire arresting screens that is passed through a wall that vents into the building. The vent can be installed on old and new construction to provide improved fire prevention, increase the value and salability in fire prone areas.

20 Claims, 8 Drawing Sheets

(56) References Cited

U.S. PATENT DOCUMENTS 4,899,647 A * 2/1990 Garries ..... E06B 7/02 454/277
4,915,023 A * 4/1990 Porter ..... E06B 7/082 403/401
4,958,555 A * 9/1990 Lentz ..... F24F 13/08 454/277
5,204,497 A * 4/1993 Herrick ..... G06F 1/182 174/383
5,297,373 A * 3/1994 Olsen ..... E06B 7/082 52/473
5,542,224 A * 8/1996 Olsen ..... F24F 11/08 454/277
5,729,935 A 3/1998 Schiedegger et al.
5,782,051 A * 7/1998 LaVoie ..... F24F 13/08 454/277
5,839,244 A * 11/1998 Johnson ..... F24F 13/08 454/224
6,095,918 A * 8/2000 Arroyo ..... F24F 3/1607 454/188
6,174,231 B1 1/2001 Bodin
6,390,914 B1 5/2002 P'Hagin et al.
6,682,415 B1 1/2004 Vagedes
7,128,643 B2 * 10/2006 Beliveau ..... E04B 1/7076 454/271
7,413,024 B1 8/2008 Simontacchi et al.
7,988,544 B2 8/2011 Vanden Bosch et al.
8,240,093 B2 8/2012 Lajewski
2002/0077059 A1 * 6/2002 Rutler ..... F24F 13/085 454/289
2008/0188176 A1 * 8/2008 Hunt ..... E04D 13/17 454/366
2009/0233538 A1 * 9/2009 Brown ..... F24F 5/0075 454/271
2009/0239462 A1 * 9/2009 Hendricks ..... F24F 13/084 454/271
2009/0286463 A1 * 11/2009 Daniels ..... F24F 7/02 454/366

* cited by examiner

| VENT SIZE Sq. in. | Total Area Sq. in | Net Free Area Sq in | 31 | 32 | 33 | 34 | 35 | 36 |
|---|---|---|---|---|---|---|---|---|
| 12 x 12 | 144 | 38 | 7.12 | 12 | 12 | 4.75 | 12 | 30 |
| 12 x 18 | 216 | 40.5 | 7.5 | 12 | 18 | 5 | 12 | 36 |
| 12 x 24 | 288 | 75.8 | 14.25 | 12 | 24 | 9.5 | 12 | 42 |
| 12 x 30 | 360 | 94.7 | 17.7 | 12 | 30 | 11.8 | 12 | 48 |
| 12 x 36 | 432 | 113.7 | 21.3 | 12 | 36 | 14.2 | 12 | 54 |
| 12 x 48 | 504 | 132.6 | 24.75 | 12 | 48 | 16.5 | 12 | 66 |
| 18 x 18 | 324 | 85.3 | 10.7 | 18 | 18 | 7.1 | 18 | 45 |
| 18 x 24 | 432 | 113.7 | 14.25 | 18 | 24 | 9.5 | 18 | 51 |
| 18 x 30 | 540 | 142 | 17.7 | 18 | 30 | 11.8 | 18 | 57 |
| 18 x 36 | 648 | 170.5 | 21.3 | 18 | 36 | 14.2 | 18 | 63 |
| 18 x 42 | 756 | 199 | 24.9 | 18 | 42 | 16.6 | 18 | 69 |
| 18 x 60 | 1080 | 284 | 35.6 | 18 | 60 | 23.7 | 18 | 87 |
| 24 x 30 | 720 | 189.5 | 17.9 | 24 | 30 | 11.9 | 24 | 66 |
| 24 x 36 | 864 | 227.4 | 21.3 | 24 | 36 | 14.2 | 24 | 72 |
| 24 x 42 | 1008 | 265.3 | 24.9 | 24 | 42 | 16.6 | 24 | 78 |
| 24 x 48 | 1152 | 303.2 | 28.5 | 24 | 48 | 19 | 24 | 84 |
| 24 x 54 | 1296 | 341 | 32 | 24 | 54 | 21.3 | 24 | 90 |
| 24 x 60 | 1440 | 379 | 35.6 | 24 | 60 | 23.7 | 24 | 96 |
| 30 x 48 | 1440 | 379 | 28.5 | 30 | 48 | 19 | 30 | 93 |
| 36 x 72 | 2592 | 682.1 | 42.6 | 36 | 72 | 28.4 | 36 | 126 |

FIG. 13

GABLE VENT THAT BLOCKS FIRE, RAIN AND WATER

CROSS REFERENCE TO RELATED APPLICATION

This application claims the benefit of Provisional Application Ser. No. 62/084,016 filed on Nov. 25, 2014 and Provisional Application Ser. No. 62/160,818 filed May 13, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a house gable air vent. More particularly, the present outside house vent that blocks embers, water and rain allows for outside air to enter into the attic space of a house, but blocks embers, water and rain from entering the attic of the house.

Description of Related Art Including Information Disclosed Under 37 CFR 1.97 and 1.98

Most houses are constructed with vents that allow for outside air to vent into the attic area of a house. The vents are typically located on the sides or roof of a house. Venting of the attic reduces heat build-up in the attic that can increase the temperature of the living area of the house. The vent allows the air to more freely move into the attic, it also allows air water and fire to enter the attic and can cause the house to catch fire or water to cause damage to the structure.

When fires burn around a house the heat and flames of the fire can blow directly against the side of the house, the flames of the fire can enter the same vent and the fire first ignites the house in the attic where there is limited protection from the heat. Most old and new constructed homes utilize the same or similar venting systems where fire and or rain can enter the home. In the case of rain that is being blown by a wind, the rain can be blown into the vertical vents of the sides of a house.

The attic vents of a house have not changed to prevent this type of problem. A number of patents and or publications have been made to vent houses or buildings. Exemplary examples of patents and or publications that try to address the venting of an attic are identified and discussed below.

U.S. Pat. No. 4,214,510 issued on Jun. 29, 1980 to Bruce K. Ward discloses a Vent and Baffle Unit. The baffle in this patent is located in the rafters of a house and sits between the joists. While this patent allows for air movement through a vent in the eves, it does not prevent fire embers or water from entering the attic. This patent further does not have a screen to prevent embers form coming in. In regard to rain, the baffle may help to reduce rain intrusion, but this patent essentially discloses providing an air path for ventilate into the structure thru the eaves of a house.

U.S. Pat. No. 4,785,596 issued Nov. 22, 1988 to Byron C. Wiley et al discloses an Attic Vent that is secured to the vertical side of a building. The vent allows for free air movement into the attic or unoccupied area of a building or house. This patent does not provide prevent fire from being blown into the house through the attic vent and driven rain can pass through the vent.

U.S. Pat. No. 5,729,935 issued Mar. 24, 1998 to Charles E. Schiedegger et al., discloses a Gable Vent. The gable vent extends away from the vertical wall and allows for air to pass vertically through the gable vent. Hot embers can be blown through the gable vent where the house can catch fire.

U.S. Pat. No. 5,782,051 issued on Jul. 21, 2998 to John F. LaVole discloses a Water Resistant Louver. The louver has a screen that reduces water flow or rain through the vent. The design of this patent is essentially vertical with a cosmetic cover in front of the screen and a louver behind the screen. While this patent is water resistant it does not prevent fire intrusion.

What is needed is an attic ventilation system where the venting mechanism is location outside of the house or structure. The ventilation system can be exposed to rain and embers without allowing the rain or embers to pass through the vent and enter into the attic or rafters of the house or building.

BRIEF SUMMARY OF THE INVENTION

It is an object of the outside house gable vent that blocks fire embers, water and rain to prevent fire in homes and other buildings in high fire areas. The prevention of fire and ember intrusion into a building prevents fires in homes where invalids and children are left alone. This can further save art and other things of value passed down from generation to generation. The prevention of water into structure further reduces the potential for mold growth in the attic or walls of a home or structure. The filtering further prevents intrusion of creatures such as but not limited to bugs, insects, bees, wasps, animals, critters and other flying and crawling animals from entering the building.

It is an object of the outside house gable vent that blocks fire embers, water and rain to be installed on preexisting structure as a retrofit or on new or reconstruction of a home to provide improved fire protection. The vent can further be designed for installation on new construction to provide improved fire prevention. This can further provide for a more salable home in fire prone areas.

It is an object of the outside house gable vent that blocks fire embers, water and rain to potentially reduce the cost of home and life insurance by reducing their incidence. This could reduce the number of personnel required by the insurance companies to provide services to customers and could provide an overall cost reduction to the industry that would provide more incentive for other insurance companies to enter the field of building insurance in fire prone areas.

It is another object of the outside house gable vent that blocks fire embers, water and rain to help cities and towns by reducing the work load of fire departments and other personnel in the towns and cities. It can further reduce or eliminates insurance costs to municipalities for fire-fighting personnel.

It is an object of the outside house gable vent that blocks fire embers, water and rain to require a slight protrusion in the gable area of each building. This eliminates most existing louvered and round vents. The venting can take a variety of shapes or structures such as but not limited to round, oval, square, rectangular and ached. The vent can be easy painted to match the existing building colors and can easily be used with all types of construction i.e. brick, stucco etc.

It is another object of the outside house gable vent that blocks fire embers, water and rain to provide greater efficiency of each unit thereby requiring less vents to proving venting. The vent is arranged to prevent ultra violet rays of light from causing damage that exists with many vents already in use.

It is another object of the outside house gable vent to fit into the existing stud wall of the house. The vent utilizes a plurality of angled louvers placed between vertical screens to block both water and fire from making the multiple changes in flow direction to reduce particles or hot embers or water from passing inside of the structure.

It is still another object of the outside gable house vent that blocks fire embers, water and rain to have internal water gutter and drain to collect water that enters the vent to be routed to a central drain location. Because the vent has an initial screen, the screen blocks particles such as leaves and bugs from entering into the louvers where bugs, leaves or sticks could fall into the gutter and block the drain.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 13 shows a table of different size vents that can be installed.

DETAILED DESCRIPTION OF THE INVENTION

Figure 1:
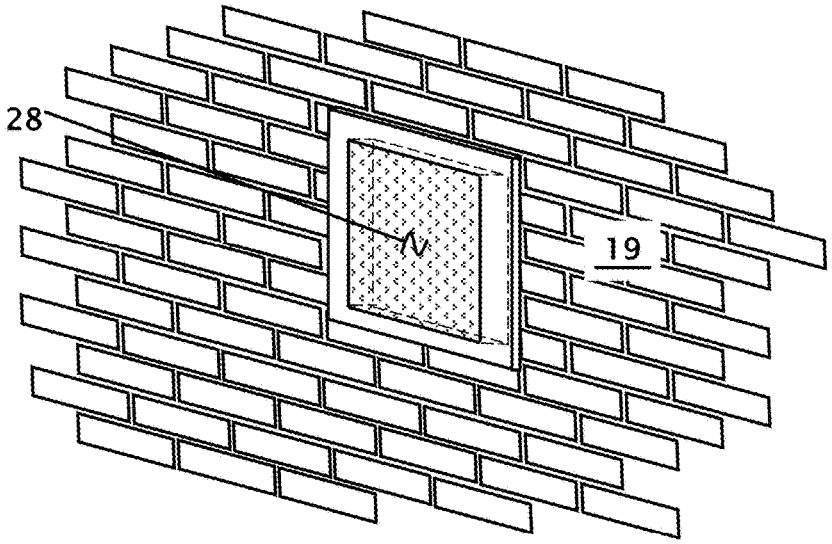
FIG. 1 shows a perspective view of the vent on the side of a building.

FIG. 1 shows a perspective view of the vent on the side of a building 19. In most currently constructed homes or buildings the side of the building has a vent that is essentially the same size and shape where the filter 28 is shown in this figure. The vent fits essentially in the same opening. In the embodiment shown the inlet to the vent is at the front of the vent 28 and is covered with a screen material. While different size of holes and spacing has been tested, the ideal ratio will provide flow of air, but block water and fire from penetrating one or more layers of the vent. In one contemplated embodiment the front of the vent 28 is covered with a material such as 20 gauge 5052-H32 aluminum, but other materials are contemplated. The front screen has 0.156 diameter holes places 0.187 on center. This ratio provides a 63% open area in the screen for air to pass through. This diameter of hole is sufficiently small to block most insects and nearly all tree and leaf debris.

Figure 2:
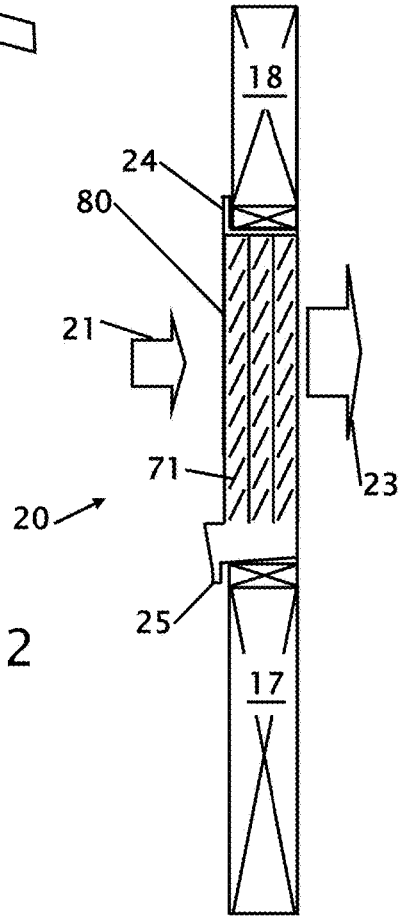
FIG. 2 shows side cross-section view of the vent on a side wall of a building.

FIG. 2 shows side cross-section view of the vent on a side wall of a building. The vent is shown mounted onto an upper stud 18 and a lower stud 17. The vent 20 is secured to the existing stud opening or the opening can be enlarged to increase the airflow into the attic. After installation on the house or building, a generous bead of sealant under the mounting flange prevents water that normally runs down the side of the building wall, from entering the building. The vent 20 has a flange area 24 that surrounds the passage into a house. The flange allows the vent 20 to be mounted onto the structure and the flange can be mounted to the outside of the structure or can be mounted directly onto the wall studs and then covered with a cosmetic surface of wood, brick, stone or stucco or other desired material.

The air 21 flowing into the vent enters into the bottom of the vent 20 through the first filter or screen 80. The air flows through the louvers, only louver 80 is identified in this figure, and out 23 the back of the vent 20. While the vent 20 is shown with multiple screens and louvers, the quantity and placement of these items can be adjusted based upon the expected with and rain direction. The bottom front edge of the vent 20 have a drain 25 to let any accumulated water within the vent to run out of the front of the vent. Detailed views and description are shown and described in to figures in this document.

Figure 3:
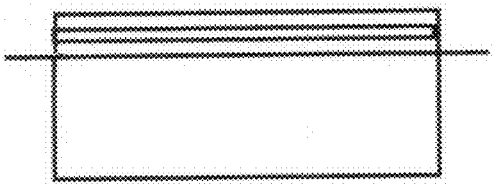
FIG. 3 shows a top plan view of the vent.
Figure 4:
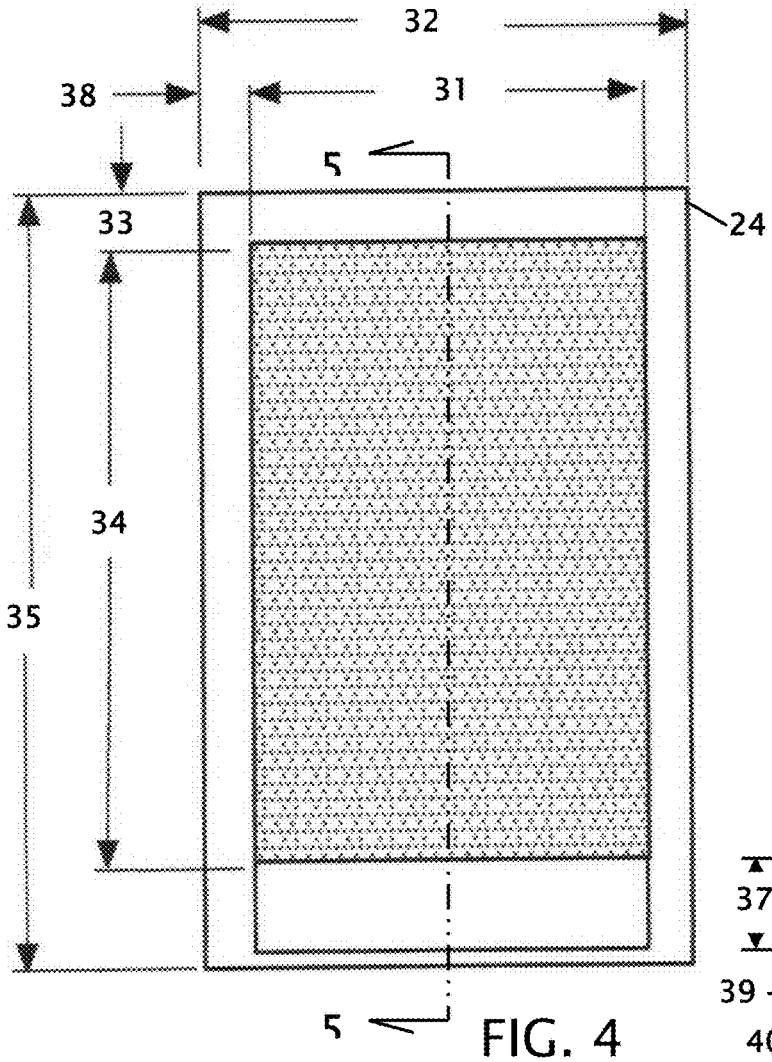
FIG. 4 shows a front plan view of the vent.
Figure 5:
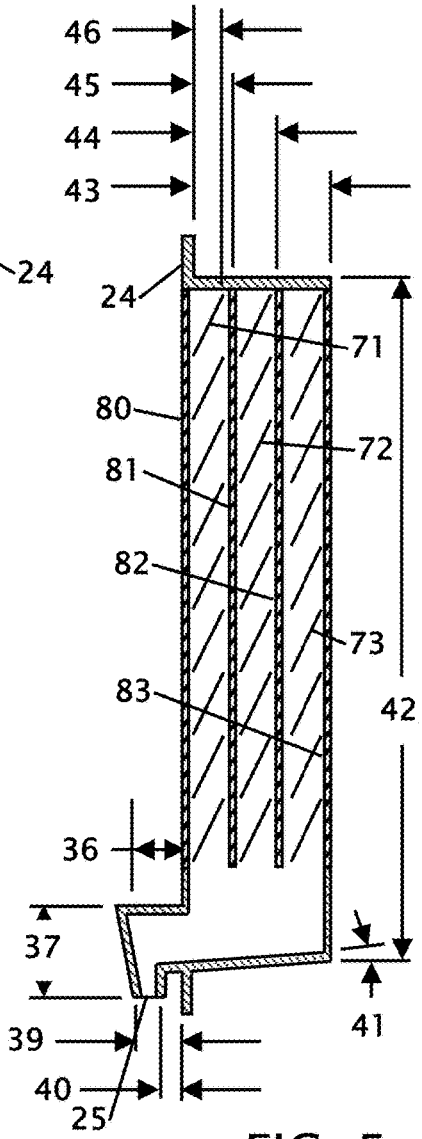
FIG. 5 shows a side cross-sectional view cut through line 5-5 from FIG. 4.

FIG. 3 shows a top plan view of the vent FIG. 4 shows a front plan view of the vent and FIG. 5 shows a side cross-sectional view of the vent cut through line 5-5 from FIG. 4. The vent is configured to fit within existing stud dimensions and can also be designed to fit into new construction. The overall height 35 and width 32 of the vent is shown. The opening of the vent also has a height 34 and a width 31. The width 31 is equally placed between the sides 38 of the overall width 32. The top of the opening has a flange spacing 33 for mounting the vent to an upper stud.

From FIG. 5, the inside of the vent has a height 42. This embodiment shows four screens 80, 81, 82 and 83 with three louvers 71, 72 and 73. The louvers are all placed in the same angle direction whereby any water entering the vent must make three separate vertical changes as the water and air is blown into the vent. At the top of this figure the dimensions from the flange 24 to each of the louvers 45, 44 and 43 is shown with a dimension 46 to the front of the first screen 46. It is contemplated that all of the screen, the louvers and the housing for the vent are all constructed from the same 5052-H32 aluminum material to prevent rusting, but other material are contemplated that would provide acceptable performance. At the bottom of the vent an overhang 36 is created to provide a step 40 from the bottom flange to provide clearance for a drain opening 25.

The drain opening 25 allows for water that enters the vent, and then stopped by the louvers to fall within the vent and drain out the front of the vent at a distance 39 and 40 away from the flange to prevent or reduce watermarks from staining the house or building. The inside bottom surface of the vent is angled 41 to drain the water from the vent. The height 37 and dimensions of the drain 25 provide an opening of approximately ½ inch, but other dimensions are contemplated based upon testing results.

Figure 6:
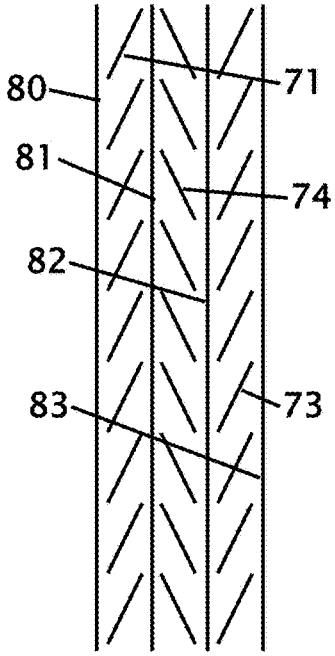
FIG. 6 shows a second cross-sectional embodiment of the vent.

FIG. 6 shows a second cross-sectional embodiment of the vent. This embodiment places the second louvre 74 at a different angle from the first 71 and third 73 louver to force water downward prior to the last louver 73.

Figure 7:
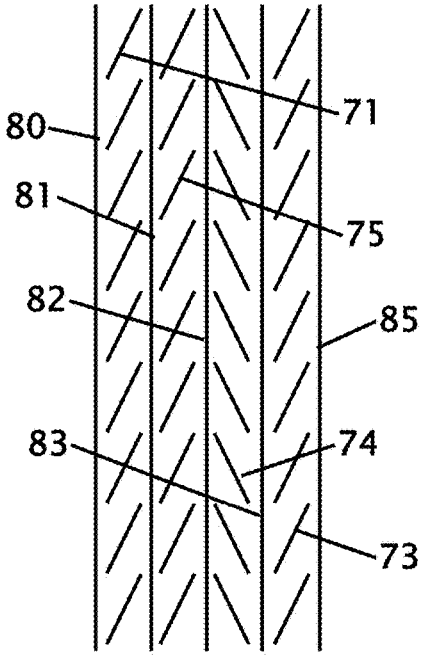
FIG. 7 shows a third cross-sectional embodiment of the vent.

FIG. 7 shows a third cross-sectional embodiment of the vent. This embodiment shows four louvers 71, 73, 74 and 75 along with five screens 80, 81, 82, 83 and 85. Louver 74 is inverted. It is contemplated that many different orientations and directions of louvers can be placed to match the wind and rain characteristics as well as the wall stud thickness and the amount of fire protection.

Figure 8:
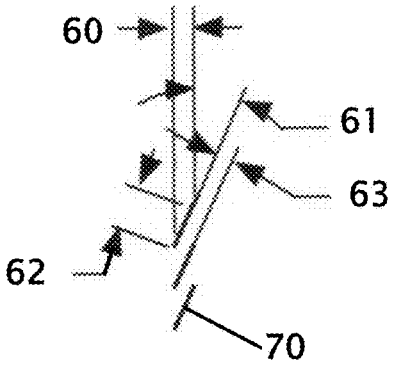
FIG. 8 shows a detail of one set of louvers.

FIG. 8 shows a detail of one set of louvers 70. The louver are preferably placed at an angle 61 of approximately 35 degree. Testing has shown this angel to provide desirable results, but angles as low as 10 degrees or as high as 80 degrees will provide differing result of water and fire intrusion prevention. The louvers 70 have width 62 and a combined overall width 60 based upon the requirements to fit within the stud wall. The louvers are also spaced apart 61 in a parallel orientation for installation in a ceiling wall.

Figure 9:
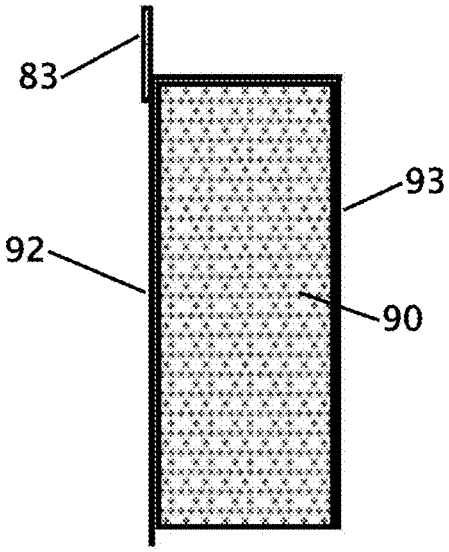
FIG. 9 shows a cross-section of a fourth preferred embodiment.

FIG. 9 shows a cross-section of a fourth preferred embodiment. In this embodiment a porous non-deteriorating non-flammable filter material 90 is used between the front 92 and the rear 93 screens. The screens 92 and 93 are preferably made from 16 gauge 5052-H32 aluminum with 63% openings. The opening s are 0.156 diameter holes on 0.187 centers, but similar or equivalent material is further contemplated.

Figure 12:
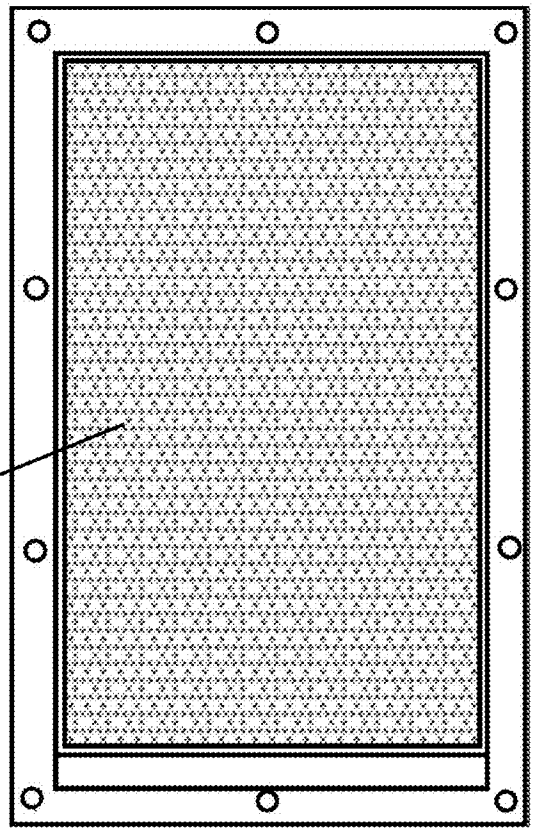
FIG. 12 shows a rear view of the view of the fourth preferred embodiment.
Figure 11:
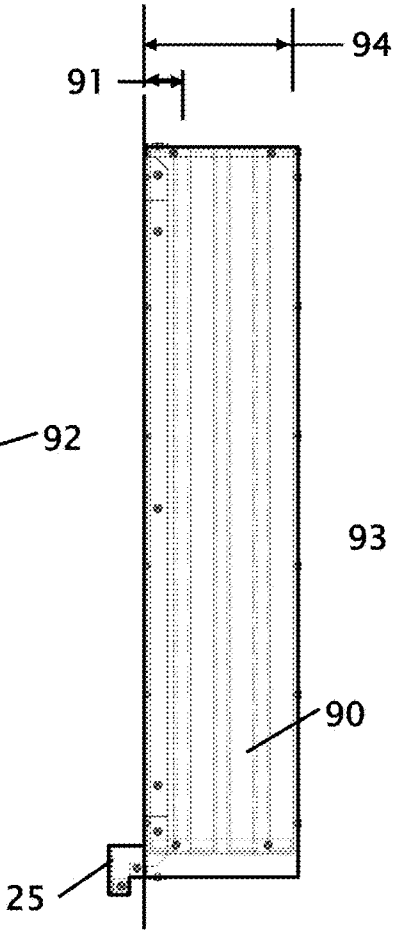
FIG. 11 shows a side view of the view of the fourth preferred embodiment.
Figure 10:
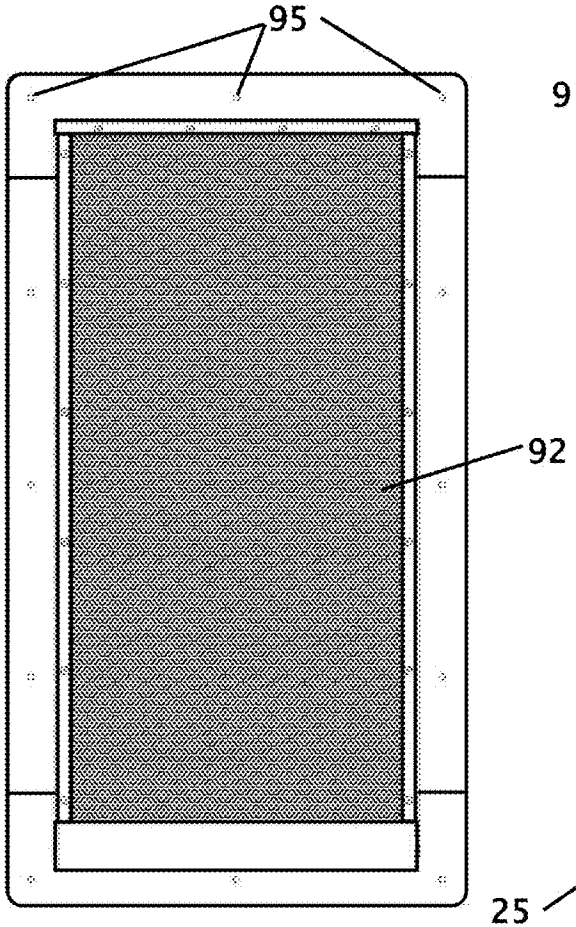
FIG. 10 shows front view of the fourth preferred embodiment.

FIG. 10 shows front view of the fourth preferred embodiment, FIG. 11 shows a side view of the view of the fourth preferred embodiment and FIG. 12 shows a rear view of the view of the fourth preferred embodiment. The exterior configuration of this embodiment is similar to the previous embodiment shown where the outside house vent that blocks embers, water and rain fit into an existing or new house vent and can be constructed in various standard and custom sizes. The outside house vent that blocks embers, water and rain has a front mounting flange with a plurality of mounting holes 95. The body of the outside house vent that blocks embers, water and rain is contemplated to be 0.040 thick 5052-H32 aluminum, but equivalent or superior materials are also contemplated. The bottom of the outside house vent that blocks embers, water and rain has a drain opening 25. The drain opening has a screen mounted to the drain to prevent bugs or other undesirable creatures from entering into the vent from the drain 25.

Two configurations are contemplated, where a first configuration is with a flange at 91 and a second configuration is with a flange at 94. The first configuration is for retro fitting to an existing house or structure, while the second configuration is for new construction. The flange allows for fascia or stucco to be placed around the outside house vent that blocks embers, water and rain. The front surface 92 and the rear surface 93 are covered with a screen that provides a front covering and also retains the porous non-deteriorating non-flammable filter material 90 within the vent.

FIG. 13 shows a table of different size vents that can be installed. This table is for reference only and will be completed based upon testing and evaluation as the product is developed and the non-provisional version of this application is prepared.

Figure 14:
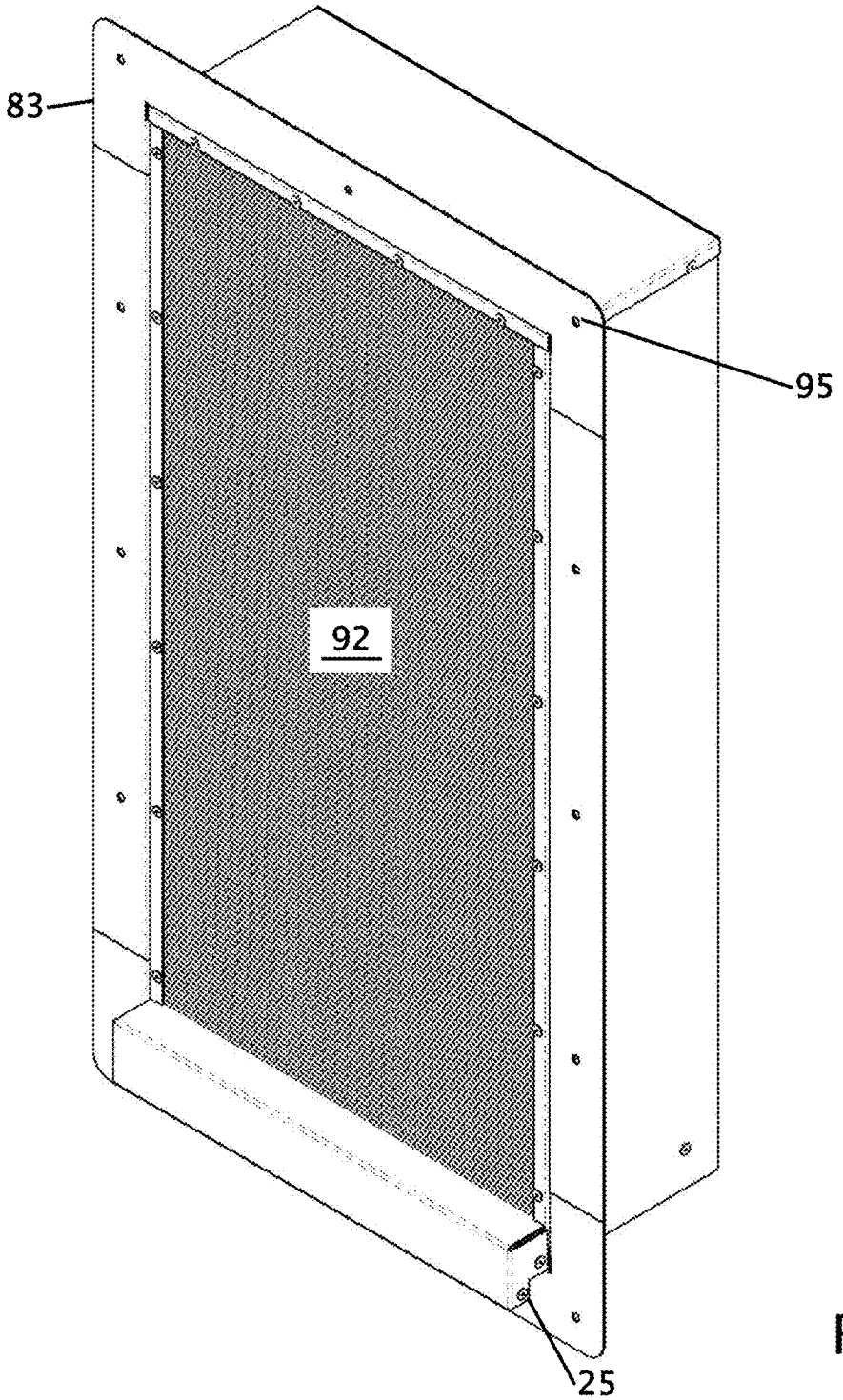
FIG. 14 shows a perspective view of the fourth preferred embodiment.
Figure 15:
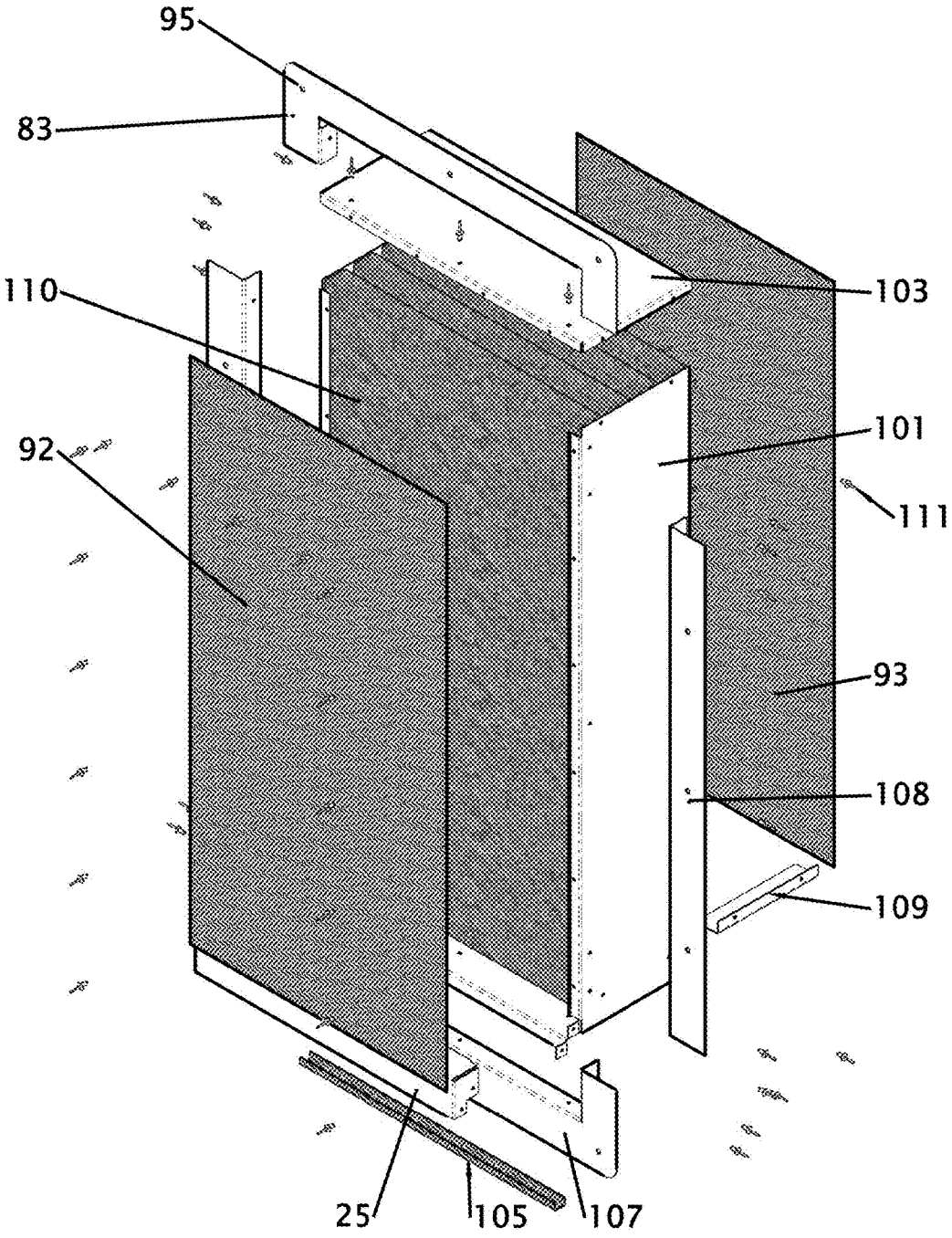
FIG. 15 shows an exploded isometric view of the fourth preferred embodiment.

FIG. 14 shows a perspective view of the fourth preferred embodiment and FIG. 15 shows an exploded isometric view of the fourth preferred embodiment. In this embodiment the front of the vent has a frame or upper flange 83 with an external screen 92. The drain spout 25 is visible extending out the lower front of the vent. A plurality of securing holes 95 are shown. From the exploded view a plurality of filter pads 110. Four filter pads are shown in this configuration, but as few as one to more than four are contemplated. The filter pads 110 allows air to pass through the filter pad(s) 110, stops fire from penetrating through the filter pads 110 and slows water from passing through the filter. As water, or wind-blown water is pushed into the filter, the filter pads 110 slow the water and the water then runs down the filter pads 110, to the filter pad support flange 109 and then out of the drain spout 25. A drain spout screen 105 prevents intrusion from bugs or other undesirable elements from entering into the drain. The drain spout screen 105 also prevents fire from entering up through the filter. Air that passes through the filter pass out of the rear of the filter through the external screen 93.

The construction of the filter has side vent housings 101 that are secured from above with a top cover 103 and the bottom cover that connects to a flange bottom 107. Side flanges 108 connect between the upper and lower covers and also are secured to the side vent housings 101. An upper flange 83 and lower flange bottom 107 are connected to the frame. Pop rivets 111 or other securing fasteners retain the frame elements together.

Figure 16:
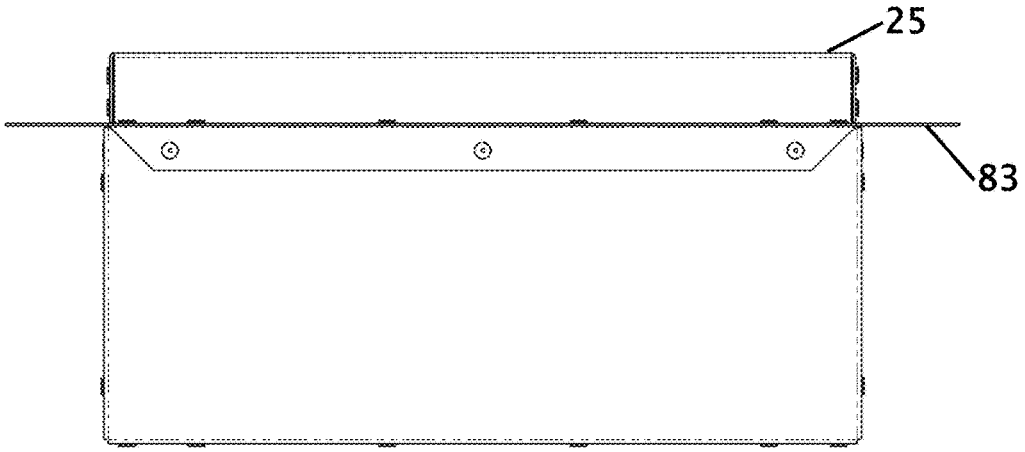
FIG. 16 shows a top view of the fourth preferred embodiment.
Figure 17:
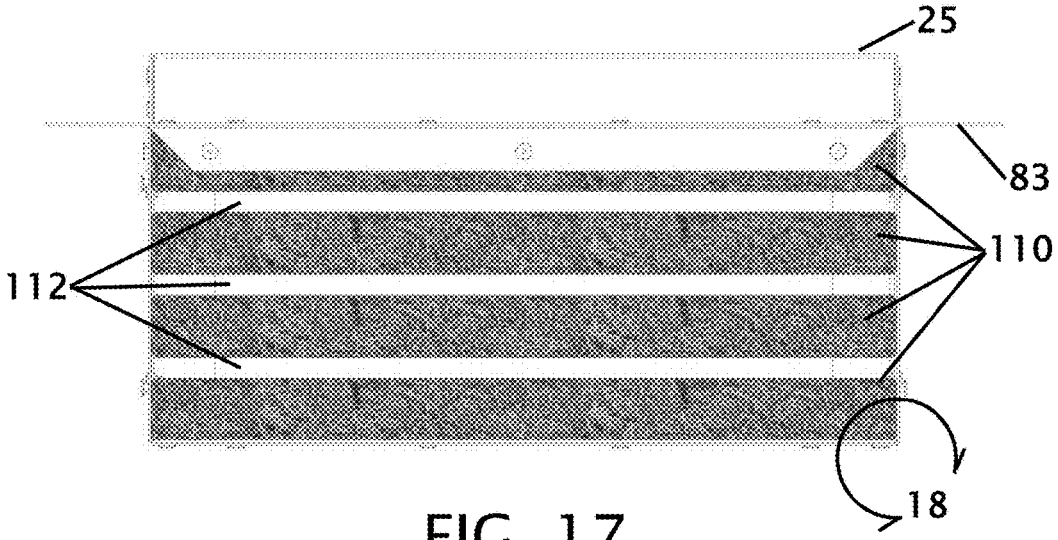
FIG. 17 shows a sectional view of the fourth preferred embodiment.

FIG. 16 shows a top view of the fourth preferred embodiment and FIG. 17 shows a sectional view of the fourth preferred embodiment. The drain spout 25 is shown extending from the front of the filter frame in front of the mounting flange 83. The multiple filter pads 110 are shows in the cross-sectional view of FIG. 17. An air gap 112 is placed between each filter pad 110. The air gaps 112 allow material or water to drop between the pads 110 where it can be washed down and out of the filter. Without the air gaps 112, water can be blown progressively through each pad 110. The materials used, including the filter pads, internal and external screens are made from non-flammable materials and materials that are not deteriorated from water.

It should be seen from this figure that the frame can be constructed with an operable lid that allows the filters 110 to be removed for cleaning and then re-inserted into the frame. Cleaning removes small particulars that can clog the filter and thereby prevent air movement through the filter.

Figure 18:
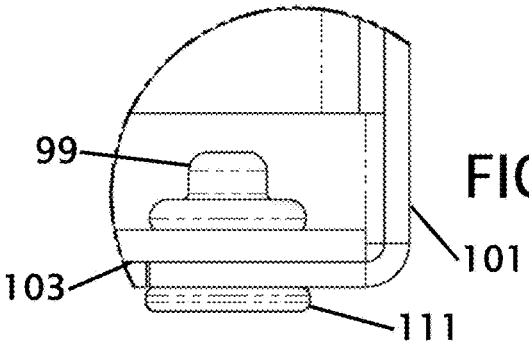
FIG. 18 shows a detail view from FIG. 17.

FIG. 18 shows a detail view from FIG. 17. The blind rivet 110 is typical of all the rivets and seals 99 the openings. The rivet 111 is shown retaining the vent housing 101 and the top cover 103. The blind rivet 111 provides load sharing between the front and rear panels.

Thus, specific embodiments of an outside house vent that blocks ember, water and rain have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An outside house vent that blocks embers, water and rain comprising:

a housing having a front flange;

said front flange having a rear mounting surface and a front cosmetic surface;

an inlet having a first screen in proximity to said inlet;

an outlet parallel to said inlet having a last screen proximate to said outlet;

said inlet having a first cross-sectional air flow area;

at least two filter pads placed between said first screen and said last screen;

at least one air gap existing between and commonly under said at least two filter pads whereby embers, water and rain that falls onto either of said at least two filter pads drops into said at least one air gap, and said housing having a fluid collection tray under said air gap and under said at least two filter pads;

a drain located at a bottom surface of said housing whereby water collected within said at least one air gap under said at least two filter pads is drained to a location beyond said front cosmetic surface.

2. The outside house vent that blocks embers, water and rain according to claim 1 wherein said first screen and said last screen being parallel to each other.

3. The outside house vent that blocks embers, water and rain according to claim 1 wherein said drain further includes a separate drain spout screen.

4. The outside house vent that blocks embers, water and rain according to claim 3 wherein said separate drain spout screen prevents intrusion of insects and animals through said drain.

5. The outside house vent that blocks embers, water and rain according to claim 1 wherein said first screen is a spark screen.

6. The outside house vent that blocks embers, water and rain according to claim 1 wherein said last screen is a mesh screen.

7. The outside house vent that blocks embers, water and rain according to claim 1 wherein said at least two filter pads provide at least some fire penetration through each of said least two filter pads.

8. The outside house vent that blocks embers, water and rain according to claim 1 wherein said front flange fits around a stud opening of a building.

9. The outside house vent that blocks embers, water and rain according to claim 1 wherein said front flange extends parallel to said first screen.

10. The outside house vent that blocks embers, water and rain according to claim 1 wherein said front flange extends into an opening of a building.

11. The outside house vent that blocks embers, water and rain according to claim 1 wherein said front flange further includes a plurality of mounting features for mounting said duct to an exterior of a structure.

12. The outside house vent that blocks embers, water and rain according to claim 1 wherein said duct is constructed from a fireproof material.

13. The outside house vent that blocks embers, water and rain according to claim 12 wherein said material is metal.

14. The outside house vent that blocks embers, water and rain according to claim 1 wherein said fluid collection tray is angled to direct collected fluid to said drain.

15. The outside house vent that blocks embers, water and rain according to claim 1 wherein a pre-existing attic vent is removed and replaced with said duct.

16. The outside house vent that blocks embers, water and rain according to claim 1 includes at least three filter pads.

17. The outside house vent that blocks embers, water and rain according to claim 1 includes at least four filter pads.

18. The outside house vent that blocks embers, water and rain according to claim 1 includes a plurality of blind fasteners and said blind fasteners share loads between said housing to said front flange.

19. The outside house vent that blocks embers, water and rain according to claim 1 wherein said first screen and said at least two filter pads are elevated from said air gap.

20. The outside house vent that blocks embers, water and rain according to claim 1 wherein said first screen and said at least two filter pads are elevated from said fluid collection tray.

* * * * *